US012161153B2

(12) United States Patent
Kirakosian

(10) Patent No.: US 12,161,153 B2
(45) Date of Patent: Dec. 10, 2024

(54) TOBACCO BOWL HOLDER AND TOBACCO CONTAINER CONTAINING THE SAME

(71) Applicant: Kiraco LLC, Northridge, CA (US)

(72) Inventor: Albert Kirakosian, Northridge, CA (US)

(73) Assignee: KIRACO LLC, Northridge, CA (US)

( * ) Notice: Subject to any disclaimer, the term of this patent is extended or adjusted under 35 U.S.C. 154(b) by 354 days.

(21) Appl. No.: 17/332,705

(22) Filed: May 27, 2021

(65) Prior Publication Data

US 2022/0378089 A1 Dec. 1, 2022

(51) Int. Cl.

| | |
|---|---|
| ***A24F 1/30*** | (2006.01) |
| ***A24F 5/02*** | (2006.01) |
| ***A24F 5/10*** | (2006.01) |
| ***A24F 23/00*** | (2006.01) |

(52) U.S. Cl.

CPC ..... *A24F 1/30* (2013.01); *A24F 5/02* (2013.01); *A24F 23/00* (2013.01); *A24F 5/10* (2013.01)

(58) Field of Classification Search

CPC .... A24F 1/30; A24F 5/02; A24F 23/00; A24F 5/10

See application file for complete search history.

(56) References Cited

U.S. PATENT DOCUMENTS

| | | | | |
|---|---|---|---|---|
| 2008/0060663 | A1* | 3/2008 | Hamade | A24B 13/00 131/178 |
| 2016/0262448 | A1* | 9/2016 | Zeitlin | A24F 9/02 |
| 2019/0185306 | A1* | 6/2019 | Rhoades | B67B 7/16 |

* cited by examiner

*Primary Examiner* — Christopher M Rodd
*Assistant Examiner* — Jennifer A Kessie
(74) *Attorney, Agent, or Firm* — LEWIS ROCA ROTHGERBER CHRISTIE LLP

(57) ABSTRACT

A tobacco bowl stand for supporting a tobacco bowl has an opening for receiving a hookah stem includes a base, and a protrusion extending from the base configured for being received in the tobacco bowl opening for holding the tobacco bowl in an upright position. The stand may be part of canister cap.

23 Claims, 4 Drawing Sheets

TOBACCO BOWL HOLDER AND TOBACCO CONTAINER CONTAINING THE SAME

BACKGROUND

A hookah is a device used to smoke tobacco. The device has its origins in the Middle East and Near East regions. A typical hookah 10 as shown in FIG. 1, includes a water reservoir 12. A plug, cap or gasket 14 (either of which is referred to herein as a "cap" for illustrative purposes). The cap caps the reservoir. A stem 16 penetrates the cap such that a first end 18 of the stem is external of the reservoir whereas a second end 20 of the stem opposite the first end is within the reservoir. At least one hose 22 with optionally a mouthpiece (now shown) also penetrates the cap. To use the hookah, the reservoir is partially filled with water 25 leaving a head space 26 within the reservoir free of water while submerging the second end 20 of the stem 18 within the water. Each hose 22 extends within the head space 26 of the reservoir above the water. A tobacco bowl 28 is connected to the first end 18 of the stem. Specifically, the tobacco bowl 28 includes an opening 30 extending to its lower end for receiving the first end 18 of the stem. The tobacco bowl defines a conduit 32 extending from the opening 30 to interior of the bowl. Tobacco 31 to be smoked is placed within a tobacco support 34 defined within the bowl external of the conduit. A perforated coal plate 36 is mounted over the bowl.

Hookah tobacco, if often referred to as "massell." Massell is a mixture of tobacco, molasses, and often a flavor or fruit extract, The molasses and fruit extract add a substantial amount of moisture to the massell that is missing in conventional tobacco. This added moisture makes massell more sensitive to the elements relative to conventional tobacco. To smoke the hookah, the massell or tobacco is placed within the tobacco support 34 of the bowl. The coal plate 36 is then mounted on top of the bowl covering the massell. Typically, there is a space between the upper surface of the massell and the coal plate as it is often desirable that the coal does not contact the massell. Lit coals 37 are placed on top of the coal plate. The heat from the coals ignites the massell. Smoke generated by the ignited massell travels through the conduit and the first end of the stem and exits in the water through the second end of the stem. The water cooled the smoke exits the reservoir through each hose 22 and corresponding mouth piece as the user inhales through the mouth piece.

Hookah bowls often have a narrow-width base and may be unstable when placed on a surface so a user can fill them with the appropriate tobacco. As a result they often topple over.

SUMMARY

In an example embodiment, a tobacco bowl stand for supporting a tobacco bowl having an opening for receiving a hookah stem includes a base, and a protrusion extending from the base configured for being received in the tobacco bowl opening for holding the tobacco bowl in an upright position. In another example embodiment, the base is adjacent to an inner surface of a cap of a canister having a body. The canister body may be used for holding tobacco. In a further example embodiment, the base is the cap of a cannister. In yet a further example embodiment, the protrusion is conical. In another example embodiment, the protrusion is frustum conical. In yet another example embodiment, the base extends along a plane and a dimension of the base along the plane is greater than any dimension of the protrusion along any plane parallel to the plane. In one example embodiment, the base is polygonal in plan view. In a further example embodiment, the base includes a peripheral edge and at least a portion of the peripheral edge is serrated. In yet a further example embodiment, the base extends along a plane and has a dimension along the plane of at least 2 inches. In another example embodiment, the base extends along a plane and has a dimension along the plane of at least 3 inches. In yet another example embodiment, the base extends along a plane and has a dimension along the plane of at least 3.5 inches.

In another example embodiment, a canister includes a body and a cap for capping the body. The cap has an outer surface opposite an inner surface and includes a protrusion extending relative to the inner surface in a direction opposite the outer surface and toward the body when the cap is capping the body. The protrusion is also for being inserted into a rear opening of a tobacco bowl for supporting the tobacco bowl in an upright position when the cap is resting on its outer surface. In yet another example embodiment, the canister also includes a base extending from the protrusion and the base is mated to the inner surface of the cap. In one example embodiment, the base includes a peripheral edge, the cap includes a peripheral wall extending in the same direction as the protrusion, and the base is friction or interference fitted within the peripheral wall. In another example embodiment, the base peripheral edge is serrated. In yet another example embodiment, the protrusion is removably coupled with the cap. In one example embodiment, the base is wider than the tobacco bowl. In a further example embodiment, the base extends along a plane and has a dimension along the plane of at least 2 inches. In another example embodiment, the base extends along a plane and has a dimension along the plane of at least 3 inches. In yet another example embodiment, the base extends along a plane and has a dimension along the plane of at least 3.5 inches. With any of the aforementioned embodiments, the canister is tobacco canister for holding tobacco.

DETAILED DESCRIPTION

Figure 1:
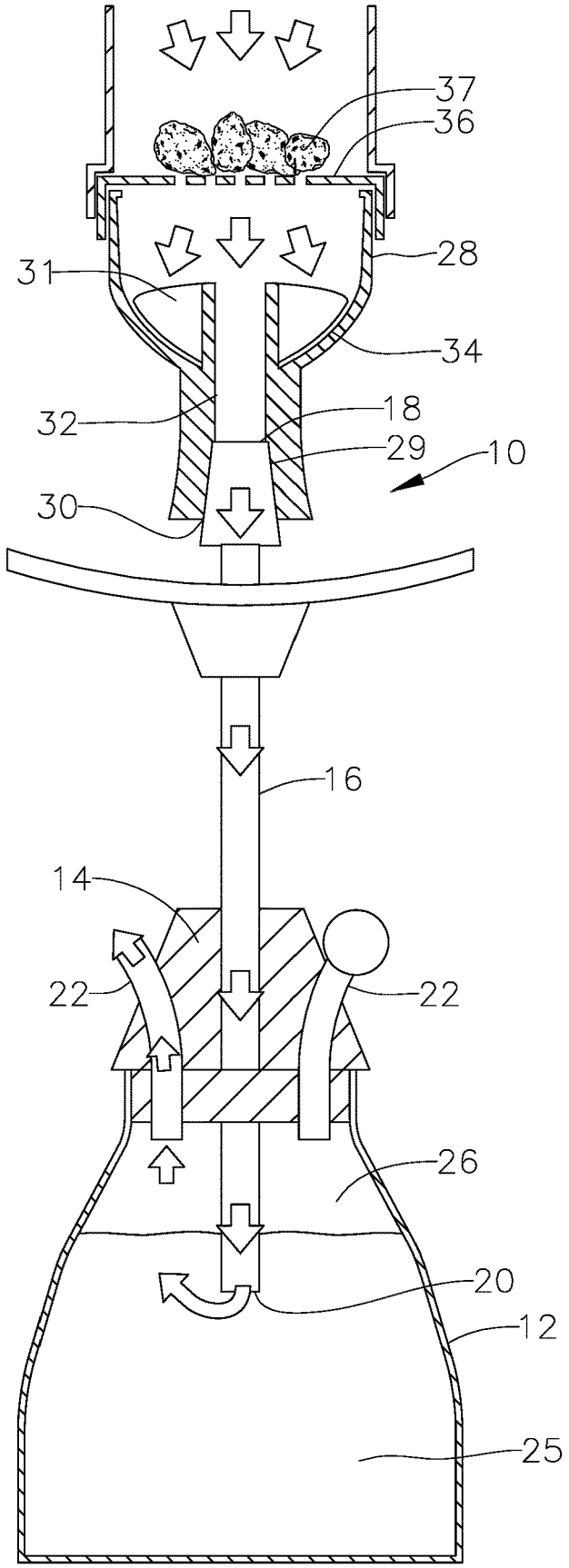
FIG. 1 PRIOR ART
FIG. 1 is a front view of a prior art hookah.
Figure 2:
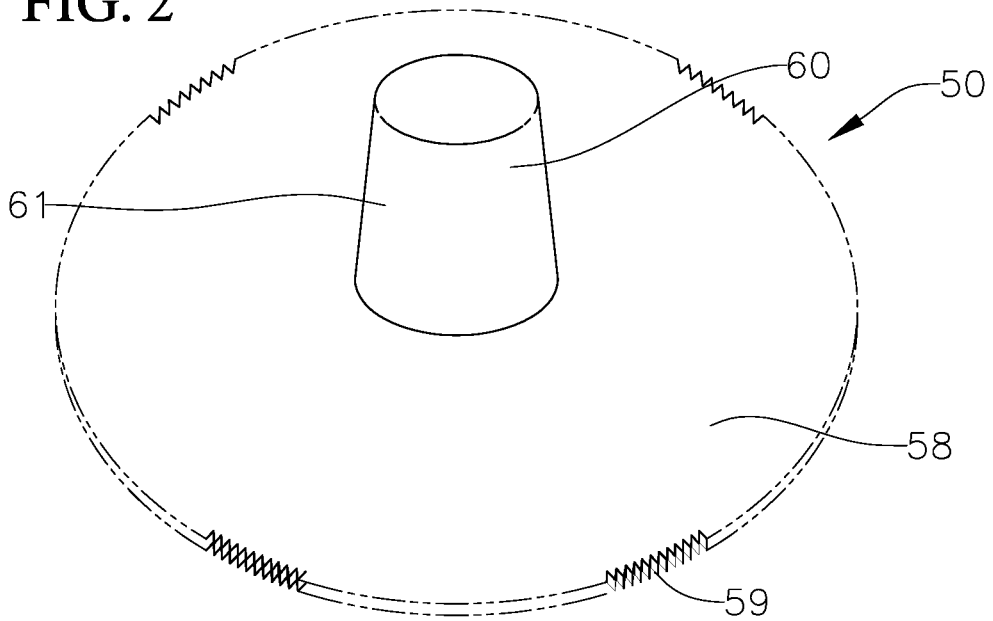
FIG. 2 is a perspective view of an example embodiment tobacco bowl stand.
Figure 3:
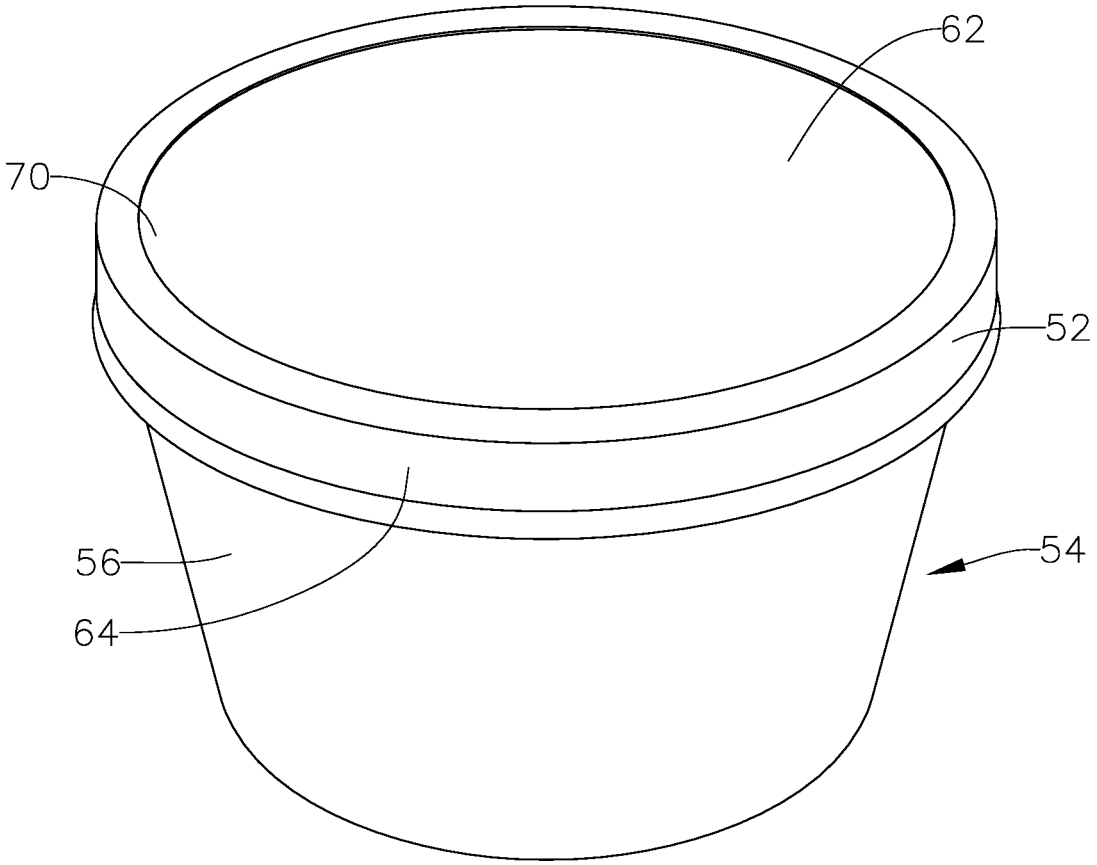
FIG. 3 is a perspective view of an example embodiment tobacco canister.
Figure 4:
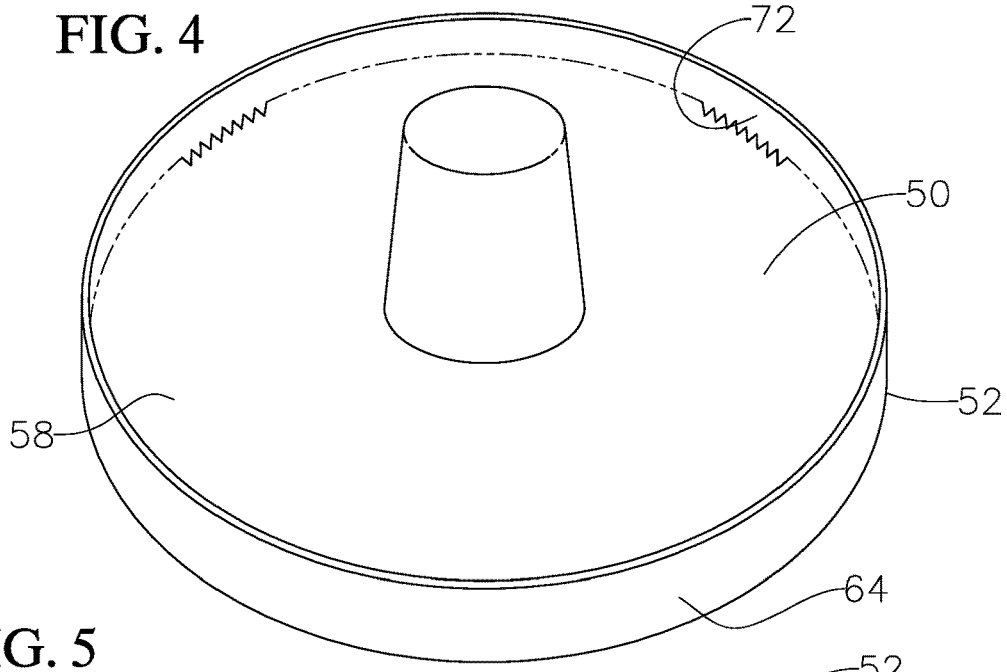
FIG. 4 a is perspective view of a cap of the example embodiment canister shown in FIG. 3 with the example embodiment stand shown if FIG. 2 mated therein.
Figure 5:
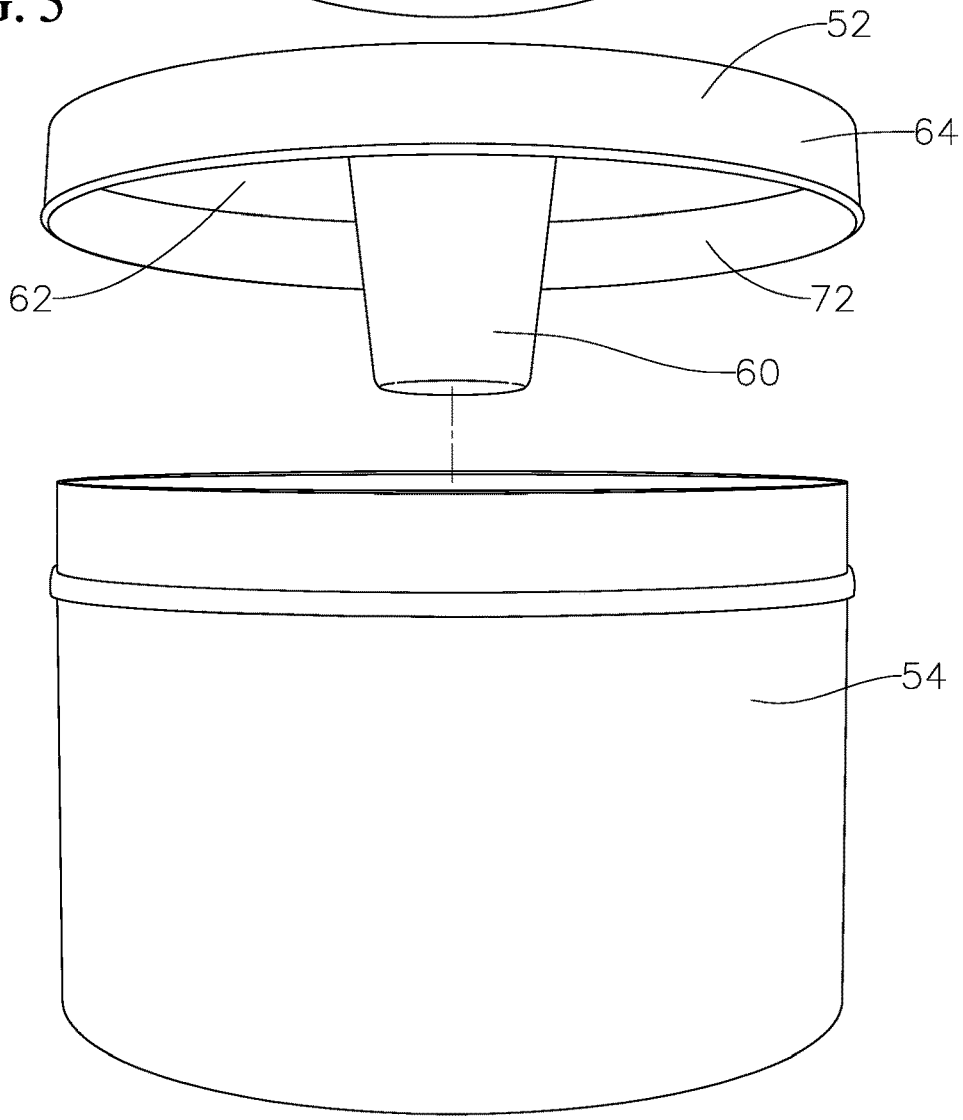
FIG. 5 is a front exploded view of the tobacco canister shown in FIG. 3 including the example embodiment stand shown in FIG. 2.
Figure 6:
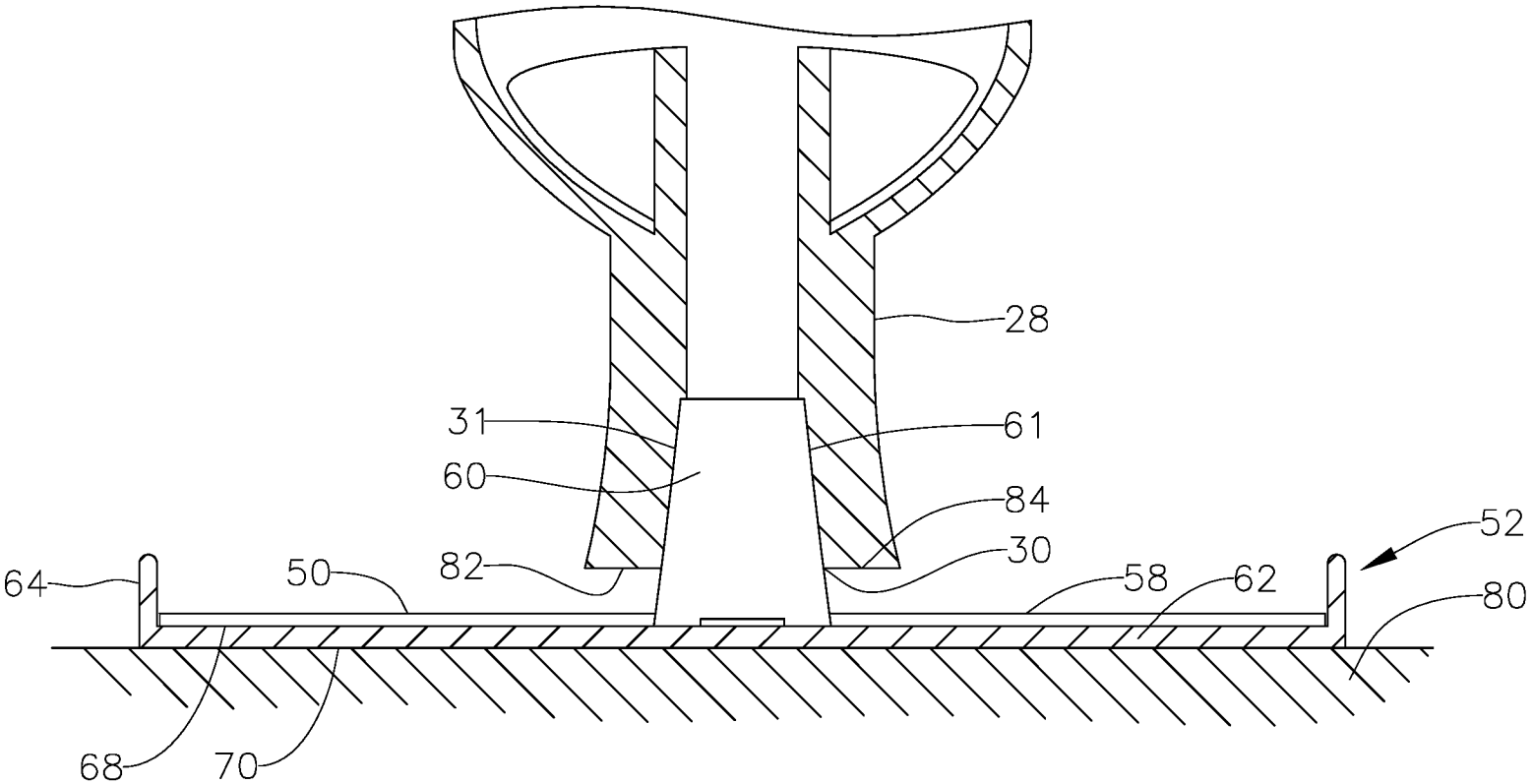
FIG. 6 is a cross-sectional view of the example embodiment stand shown in FIG. 2 inserted in the cap of the example embodiment canister shown in FIG. 3 and supporting a tobacco bowl.

In an example embodiment, a tobacco bowl stand 50 (referred as "stand" herein) is provided that fits in cap 52 of a canister for tobacco 54 (FIGS. 2, 3 and 4). Hookah tobacco or massell is typically sold in a canister such as canister 54. A tobacco canister includes the cap (e.g., a cover) 52 and a body 56 that stores the tobacco and that is covered by the cap 52 (FIG. 3). In an example embodiment, the stand 50 includes a base 58 and a protrusion 60 extending from the base. The base in an example embodiment, is made of a thin material which in an example embodiment may be a plastic or a metallic material. In an example embodiment, the base is planar extending along a plane and the protrusion extends transverse from the base and in a preferred example embodiment, perpendicularly from the base. The protrusion 60 in exemplary embodiment is conical or frustum conical, as for example shown in FIG. 2. In an example embodiment, the base and protrusion are integrally formed as a unitary structure. The cap 52 of the canister 54 includes a top wall 62 and a peripheral wall 64 extending from the top wall (FIGS. 3, 5 and 6). The top wall defines an inner surface 68 that faces the interior of the canister when the cap is capping the body (FIG. 6). The top wall also defines an outer surface 70 opposite the inner surface 68 (FIGS. 3 and 6). The base 58 of the stand 50 is fitted within the peripheral wall adjacent to the inner surface of top wall such that the protrusion protrudes in a direction away from the top wall, such that when the cap is capping the body of the canister the protrusion extends in a direction towards the body or within the body, as for example shown in FIGS. 4 and 5. In an example embodiment, the base 58 of the stand is sized so as to have a friction or interference fit with an inner surface 72 of the cap peripheral wall 64 such that it is retained within the cap and can be removed by pulling with a bit of force. In an example embodiment, a peripheral edge 59 of the base may be jagged or otherwise serrated (as for example shown in FIG. 2) so as allow for easy installation of the stand in the cap while maintaining a friction or interference fit with the peripheral wall of the cap.

When a user wants to fill the tobacco bowl with massell, the user takes the cannister cap 52 with the stand and places it on a surface 80 such that the protrusion 60 extends upward, as for example shown in FIG. 6. In another example embodiment, the stand may be removed from the cap placed directly on the surface 80. The user then places the tobacco bowl such that protrusion 60 is received in the tobacco bowl opening 30 extending to the bowl lower end 82 such that the stand supports the tobacco bowl in an upright position as shown in FIG. 6. When in this position, the user is able to fill the bowl with the appropriate tobacco.

In the example embodiment where the protrusion 60 is conical or frustum conical, with its outer surface 61 tapering to a smaller diameter in a direction away from the base 58. In an example embodiment, the tapering diameter of the protrusion outer surface is such that when sufficiently received into the opening 30 of the bowl it engages the inner surface 31 of the bowl opening as shown in FIG. 6. In one example embodiment, the tapering diameter of the protrusion is such that the tapering outer surface 61 of the protrusion engages the inner surface 31 of the tobacco bowl opening 30 preventing the bowl from contacting the base 58 of the stand. In another example embodiment a step is formed on the inner surface 31 of the tobacco bowl opening that engages an the protrusion, as for example shown in FIG. 6. In another example embodiment, the tapering outer surface of the protrusion engages the inner surface 31 of the bowl opening just as the bowl lower end 82 rests on the base 58 of the stand. In another example embodiment, the protrusion tapering outer surface dimensions are such that when received in the tobacco bowl opening 30, the tobacco bowl contacts the base of the stand and bowl can be moved laterally relative to the base to a point where the outer surface of the protrusion engages the inner surface of the tobacco bowl rear opening.

In other example embodiments, the protrusion may have other shapes than conical or frustum conical. For example, it may be cylindrical, or may be in the shape of a cube or may have any other shape that is sized to be received within the opening 30 of the tobacco bowl for supporting the tobacco bowl. The protrusion outer surface in one example embodiment has a dimension such that it fits and engages the inner surface 31 of the opening 30 providing for a tight fit. In another example embodiment, the protrusion outer surface is dimensioned to provide for a looser fit within the inner surface 31 of the opening 30.

In an example embodiment, the base 58 can have a geometric shape in plan view (i.e. a peripheral shape) that will allow it to fit within the peripheral wall of the cap. In an example embodiment, the shape of the base in plan view is complementary to the shape of the peripheral wall of the cap. For example, if the peripheral wall 64 of the cap extends along a circular path defining a cylinder, the base of the stand has a circular peripheral shape. Similarly, if the peripheral wall of the cap extends along a rectangular or square path, the base will have a complementary rectangular or peripheral shape. In other example embodiments, the peripheral shape of the base is not complementary to the shape defined by the peripheral wall of the cap. In example embodiments, only portions of the periphery (i.e., the peripheral edge) of the stand base engage the cap peripheral wall to form a friction or interference fit with the peripheral wall such that the stand can be retained by such friction or fit within the cap. In another example embodiment, the periphery of the of the base is such that when fitted within the cap it does not engage the peripheral wall.

In an example embodiment the base has a dimension such that it is wider than the base of the bowl. In an example embodiment, when the bowl is supported by the stand, the base of the stand extends beyond opposite sides of the base 84 of the bowl, as for example shown in FIG. 6. In an example embodiment, the base 68 of the bowl has a dimension of at least 2 inches. In another example embodiment, the stand base has a dimension of at least 3 inches. In another example embodiment, the stand base has a dimension of at least 3.5 inches. For example, in an embodiment, where the stand base is circular, the dimension is the diameter of the base. For example, in an embodiment where the stand base is square or rectangular, the dimension is the length of one side of the rectangular or square shape of the stand base.

In another example embodiment the stand or the base of the stand may be adhered to the cap. In a further example embodiment, the stand or the protrusion may be integrally formed with the cap such the protrusion extends from the inner surface of the top wall of the cap.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A tobacco bowl stand and tobacco bowl combination comprising:

a tobacco bowl having an opening for receiving a hookah stem; and a tobacco bowl stand comprising, a base for supporting the tobacco bowl on a flat surface, and a protrusion extending from the base being received in the tobacco bowl opening for holding the tobacco bowl in an upright position with the base below the tobacco bowl, wherein said tobacco bowl stand comprises a height as measured along the axial direction of the protrusion, wherein said height is smaller than a height of said tobacco bowl.

2. The combination as recited in claim 1, wherein the base is for being received adjacent an inner surface of a cap of a canister wherein the cannister comprises a body for storing tobacco and an opening through which tobacco can be retrieved, and wherein the cap is for covering the opening for retaining the tobacco within the body.

3. The combination as recited in claim 1, wherein said base is a cap of a cannister, wherein the cannister comprises a body for storing tobacco and an opening through which tobacco can be retrieved, and wherein the cap is for covering the opening for retaining the tobacco within the body.

4. The combination as recited in claim 1, wherein the protrusion comprises at least a conical section.

5. The combination as recited in claim 1, wherein the base is polygonal in plan view.

6. The combination as recited in claim 1, wherein the base comprises a peripheral edge wherein at least a portion of the peripheral edge is serrated.

7. The combination as recited in claim 1, wherein the base extends along a plane and wherein a dimension of said base along said plane is greater than any dimension of said protrusion along any plane parallel to said plane.

8. The combination as recited in claim 1, wherein the base extends along a plane and has a dimension along said plane of at least 2 inches.

9. The combination as recited in claim 1, wherein the base extends along a plane and has a dimension along said plane of at least 3 inches.

10. The combination as recited in claim 1, wherein the base extends along a plane and has a dimension along said plane of at least 3.5 inches.

11. The combination as recited in claim 1, wherein the base is circular in plan view.

12. The combination as recited in claim 1, wherein the protrusion extends from the base along a length, wherein the base has a thickness measured along the same direction as the length, and wherein the length is greater than the thickness.

13. A tobacco bowl stand and tobacco bowl combination comprising:

a tobacco bowl comprising an opening for receiving a hookah stem; and a tobacco bowl stand comprising, a base, and a protrusion extending from the base being received in the tobacco bowl opening for holding the tobacco bowl in an upright position with the base below the tobacco bowl, wherein the base is for being received adjacent an inner surface of a cap of a canister wherein the cannister comprises a body for storing tobacco and an opening through which tobacco can be retrieved, and wherein the cap is for covering the opening for retaining the tobacco within the body.

14. The combination as recited in claim 13, wherein the protrusion comprises at least a conical section.

15. The combination as recited in claim 13, wherein the base is polygonal in plan view.

16. The combination as recited in claim 13, wherein the base comprises a peripheral edge wherein at least a portion of the peripheral edge is serrated.

17. The combination as recited in claim 13, wherein the base extends along a plane and wherein a dimension of said base along said plane is greater than any dimension of said protrusion along any plane parallel to said plane.

18. The combination as recited in claim 13, wherein the base is circular in plan view.

19. A tobacco bowl stand and tobacco bowl combination comprising:

a tobacco bowl comprising an opening for receiving a hookah stem; and a tobacco bowl stand comprising, a base, and a protrusion extending from the base being received in the tobacco bowl opening for holding the tobacco bowl in an upright position with the base below the tobacco bowl, wherein said base is a cap of a cannister, wherein the cannister comprises a body for storing tobacco and an opening through which tobacco can be retrieved, and wherein the cap is for covering the opening for retaining the tobacco within the body.

20. The combination as recited in claim 19, wherein the protrusion comprises at least a conical section.

21. The combination as recited in claim 19, wherein the base is polygonal in plan view.

22. The combination as recited in claim 19, wherein the base is circular in plan view.

23. The combination of claim 1, wherein the protrusion comprises an outer surface that engages an entire circumference of an inner surface of said opening for providing at tight fit between the protrusion and the opening.

* * * * *